US005740817A

United States Patent [19]

Cunningham

[11] Patent Number: 5,740,817

[45] Date of Patent: Apr. 21, 1998

[54] PROCESSING OF SMOKING MATERIAL

[75] Inventor: William Cunningham, Backwell, United Kingdom

[73] Assignee: Imperial Tobacco Limited, Bristol, United Kingdom

[21] Appl. No.: 564,235

[22] PCT Filed: Jun. 23, 1994

[86] PCT No.: PCT/GB94/01359

§ 371 Date: Mar. 29, 1996

§ 102(e) Date: Mar. 29, 1996

[87] PCT Pub. No.: WO95/01108

PCT Pub. Date: Jan. 12, 1995

[30] Foreign Application Priority Data

Jun. 30, 1993 [GB] United Kingdom ..... 9313431

[51] Int. Cl.[6] ..... A24B 3/18

[52] U.S. Cl. ..... 131/291; 131/296

[58] Field of Search ..... 131/291, 301, 131/294, 296, 299, 302, 303, 900–903

[56] References Cited

U.S. PATENT DOCUMENTS 4,696,313 9/1987 Brown et al. ..... 131/291

FOREIGN PATENT DOCUMENTS 2042320 9/1980 United Kingdom ..... 131/294
2193076 2/1988 United Kingdom ..... 131/293

*Primary Examiner*—Vincent Millin
*Attorney, Agent, or Firm*—Larson & Taylor

[57] ABSTRACT

A process for treating smoking material comprising the steps of (i) heating smoking material having a moisture content of from 5 to 75% by weight at a temperature of from 70° to 220° C. at about or above atmospheric pressure in the presence of air and (ii) reducing the pressure on the heated smoking material to a level of from 0.1 to 50 kPa at a rate such that the water contained within the smoking material evaporates causing the smoking material to expand, the smoking material being heated during pressure reduction to accelerate water evaporation.

10 Claims, 2 Drawing Sheets

PROCESSING OF SMOKING MATERIAL

Figure 1:
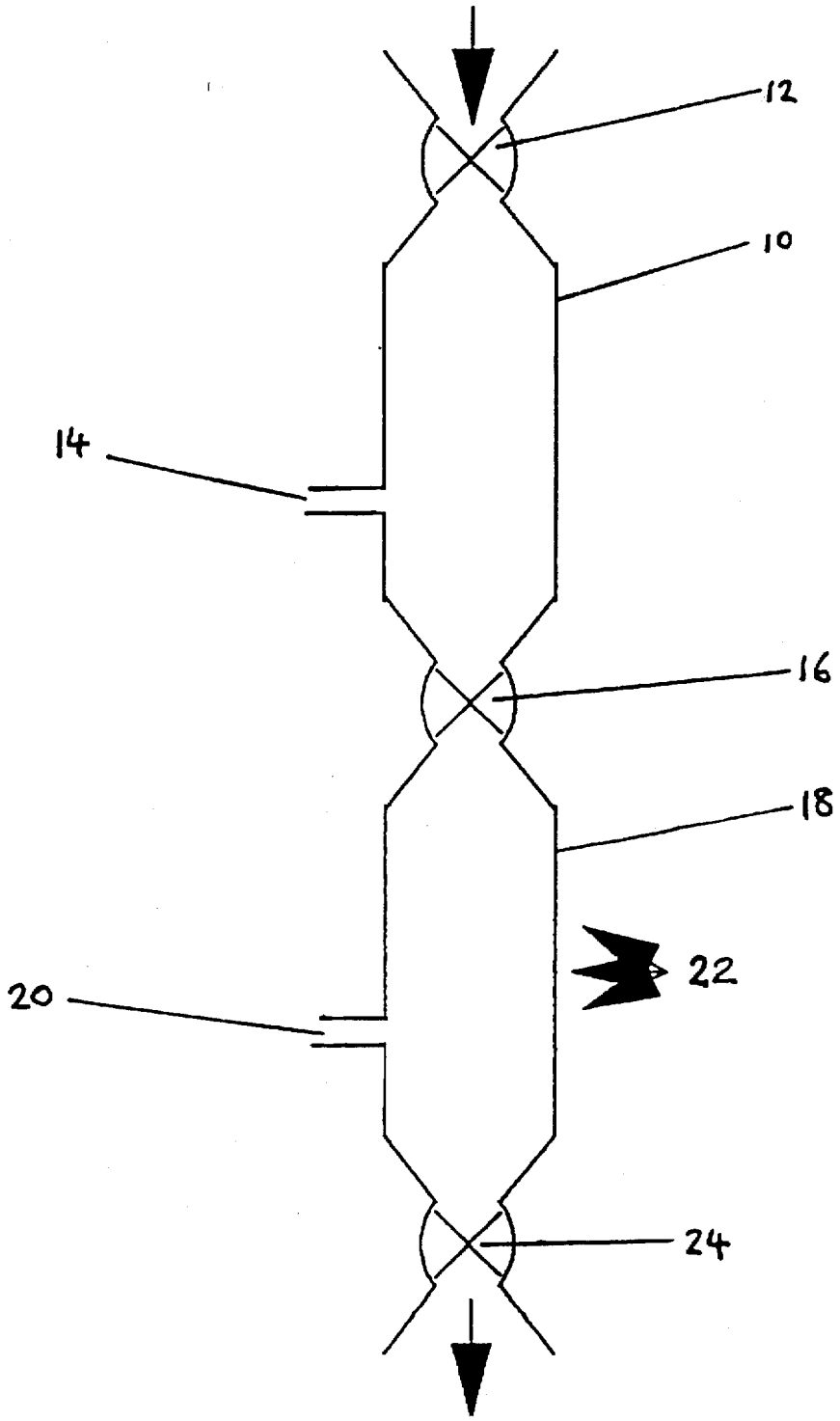

The present invention relates to processing of smoking materials, particularly tobacco and tobacco substitutes.

In the tobacco industry it is well known to expand tobacco in order to increase its bulk volume. Increasing the bulk volume of the tobacco increases the filling power of the tobacco and, in addition, smoking articles incorporating a proportion of expanded tobacco produce less tar and contain less nicotine because the weight of tobacco is reduced.

There are many known methods of expanding tobacco. One of the methods uses carbon dioxide to expand the tobacco. In this process tobacco is soaked in liquid carbon dioxide under pressure, the pressure released to solidify the carbon dioxide and then subjected to a high temperature which sublimes the carbon dioxide. The tobacco cells expand by virtue of a rapid pressure increase in the interior of the cells.

In another method, organic solvents are used to impregnate the tobacco. The tobacco is then quickly subjected to temperatures at least 30° C. above the solvent's boiling point. Again, this quick evaporation causes the cell walls of the tobacco to expand.

A further known expansion method involves the impregnation of tobacco with nitrogen under a high pressure which is generally over 10 MPa (100 bar). The tobacco is then decompressed and passed through a steam tunnel in which the temperature rises rapidly to about 90° C. thereby causing the tobacco to expand.

GB 675292 describes a process for expanding tobacco in which the tobacco is first freed from air and the air replaced by steam or water vapour. The treated tobacco is heated with steam and the pressure is then reduced to expand the tobacco. Pretreatment to remove air from the tobacco appears to be essential to the process.

The present invention involves a process for expanding smoking material which does not require a pretreatment step to remove air. It has been found that the presence of air during the process leads to no deleterious effects and, therefore, that no pretreatment to remove air is necessary.

According to the present invention, there is provided a process for treating smoking material comprising heating smoking material having a moisture content of from 5 to 75% by weight at a temperature of from 70° to 220° C. at about or above atmospheric pressure in the presence of air and reducing the pressure on the heated smoking material at a rate sufficient to expand the smoking material.

The pressure on the smoking material is preferably reduced to from 0.1 to 50 kPa (1 to 500 mbar). This has been found to give good expansion of the smoking material.

The term "in the presence of air", as used herein, means that at least 2% air is present. The atmosphere in which the smoking material is heated may be 100% air or mixtures of from 2—100% air with other gases such as steam, carbon dioxide and nitrogen.

Advantageously, the smoking material can be heated by direct application of steam, either saturated or superheated. The smoking material is heated to a temperature in the range of from 70° to 220° C. under a pressure of from 0.1 to 2 MPa (1 to 20 bar), preferably in the range from 102° to 160° C. under a pressure of from 0.11 to 0.5 MPa (1.1 to 5 bar). Alternatively, the smoking material may be heated by exposure to other relatively hot gases or radiant heat such as microwave radiation.

It is preferred that the pressure reduction to vacuum conditions is rapid and, typically, takes place in about 0.04 seconds. The process is well suited to expansion of tobacco and the bulk expansion may be in the range 20 to 100%.

Good results have been obtained where the smoking material has an initial moisture content of from 20 to 75% (more preferably 30 to 75% by weight) by weight and returns to near or below its original moisture content during the process, such as to a moisture content of up to 15% by weight. Surprisingly, by operating the process in this way the expanded smoking material retains its expanded state without requiring further treatment such as by freeze-drying.

Typically, the process of the invention is carried out as follows. Smoking material having a water content between 5 and 75% water on a wet weight basis is placed in a heating vessel. For water contents at the higher end of this range, the smoking material may require moistening by methods well-known in the art. It may be desirable to include some additives in the water used to wet the smoking material in order to improve performance in terms of improved expansion levels, resilience or the inherent smoking properties of the smoking material. Heat is applied until the desired temperature and pressure are achieved. The smoking material is then subjected to rapid depressurisation to vacuum conditions, either by rapidly reducing the pressure in the vessel or by transferring the smoking material directly to a second vessel under vacuum conditions. The rapid pressure reduction combined with the heat in the smoking material causes rapid evaporation of the water contained within the cell structure of the smoking material and results in its expansion. The smoking material may be subjected to one or more such stages of heating followed by rapid pressure reduction to partial vacuum pressures.

Indirect heat may be applied to the smoking material during and/or after the vacuum stage (preferably during the vacuum stage) to accelerate the water evaporation. This can be achieved in a number of ways such as by radiant heat (e.g., microwave or infra-red radiation). This aspect of the invention may conveniently be carried out by heating the smoking material using microwave radiation before pressure reduction and continuing the heating in the same vessel after pressure reduction. The resulting dried expanded product has a more stable structure.

From the tobacco production point of view the above process could be used for batch expansion of tobacco or could be incorporated as an on-line, continuous process stage. The latter would of course reduce handling and storage requirements.

The expanded tobacco can therefore, when heated in air, be produced without using substances which are expensive and require recovery systems which increase process costs. The expanded tobacco is resilient and is not prone to degradation. In addition water does not tend to leach out constituents of the tobacco.

It is anticipated that Filling Power Improvement (FPI) will be in the range 20 to 100%. With an FPI of 30% the tobacco weight of a smoking article could be reduced by as much as 17%. With a FPI of 60% the tobacco weight could be reduced by as much as 26%.

Due to the resilience of expanded tobacco produced by the present invention there are no practical limits to the amount that can be used in the production of a smoking article, whether it be a cigarette or a cigar.

The present expanded tobacco compares very favourably with the known expanded tobaccos in performance whilst at the same time being formed by a process having the distinct advantages described above.

Figure 2:
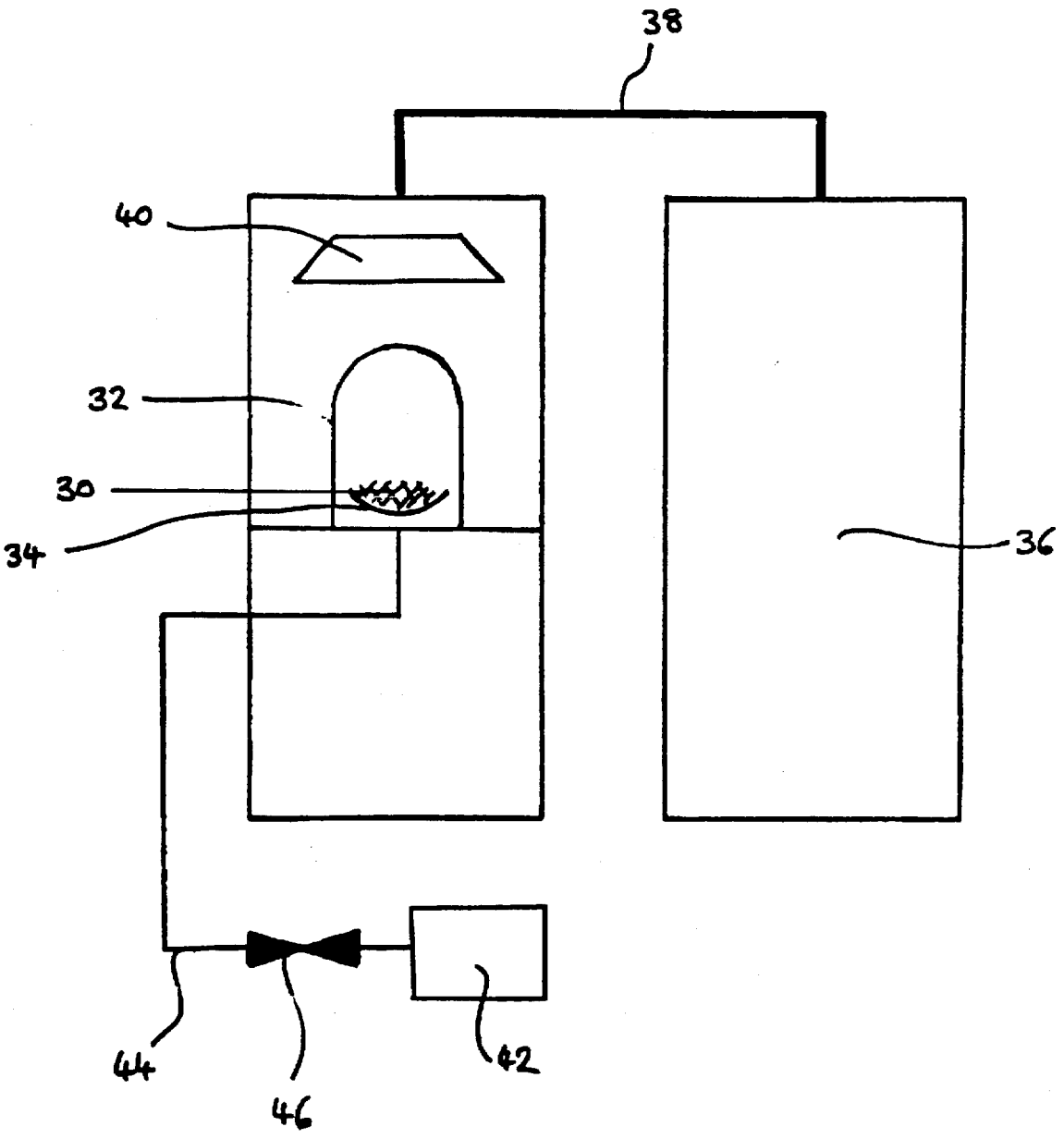

FIGS. 1 and 2 show, by way of example, schematic diagrams of apparatus which may be used for carrying out the process of the present invention.

Referring to FIG. 1, smoking material (not shown) enters pressure chamber 10 through a first seal 12 where it is treated with pressurised steam supplied through inlet 14. The treated smoking material then passes through a second seal 16, with air locks as appropriate, into vacuum chamber 18 connected to a vacuum by outlet 20. Heat source 22 provides radiant heat to maintain the temperature of the smoking material at a given value whilst the vacuum is applied. The resulting product, expanded tobacco, is removed from chamber 18 via a third seal 24 with appropriate air locks.

Referring to FIG. 2, smoking material 30 is supported in glass bell jar 32 by sample support 34. Smoking material 30 is heated by exposure to microwave radiation from microwave generator 36 via wave guide 38 and mode stirrer 40. With vacuum pump 42 on, valve 46 is opened to reduce the pressure in bell jar 32 via connecting line 44 to expand the smoking material. Heating may be continued to lower the moisture content of the expanded tobacco even further.

EXAMPLE 1

Cigar filler tobacco was heated in saturated steam at a pressure of 200 kPa (2 bar) for the times shown in Table 1 below. The temperature of tobacco will have reached or nearly reached 133° C., the temperature of the steam. After the steam supply was shut off, the tobacco was depressurised by opening a valve to an attached vacuum source at a pressure of 0.8 kPa (8 mbar) and the temperature allowed to drop only to a given cut off temperature. The results are shown in Table 1.

TABLE 1

| Starting Moisture (%) | Starting Filling Value ($cm^3/g$) | Steaming Time (minutes) | Cut Off Temperature (°C.) | Final Filling Value ($cm^3/g$) | Final Moisture (%) | Overall FPI (%) |
|---|---|---|---|---|---|---|
| 26 | 5.17 | 1 + 1* | 50 | 5.79 | 31.3 | 22.9 |
| 26 | 5.17 | 1 | 30 | 5.68 | 34.3 | 20.6 |
| 26 | 4.99 | 1 | 45 | 5.62 | — | 23.8 |
| 32 | 5.11 | 1 | 50 | 5.62 | — | 23.8 |
| 30 | 5.22 | 1 + 1* | 50 | 5.73 | 38 | 21.7 |
| 30 | 5.22 | 1 | 30 | 5.96 | 33.3 | 26.5 |
| 30 | 5.22 | 1 / 1* | 50/30 | 5.79 | 46 | 22.9 |

*+1 indicates that the steam was turned off after the initial steaming time and the tobacco was allowed an additional one minute soak time prior to the vacuum being pulled.
/ indicates multiple cycles with steaming times for each cycle and temperature attained with vacuum before re-steaming or end of test.

EXAMPLE 2

Tests were carried out using a 6 kW microwave oven equipped with a vacuum pump capable of achieving a pressure of about 2.5 kPa (25 mbar). The apparatus used for the tests is the same as that shown schematically in FIG. 2.

The basic sequence of the process was as follows:

1 Place a small sample of tobacco under the glass bell jar.

2 Turn on the vacuum pump with the connecting valve in the closed position.

3 Turn on the microwave source at full power to preheat the tobacco.

4 With the microwave power still on, open the vacuum valve.

5 Allow the microwave cycle to complete. Depressurise the bell jar and remove the sample.

The results of the tests carried out on cigarette cut lamina and cigar filter are shown in Table 2.

TABLE 2

| Heating Time (secs) | Vacuum Time (secs) | Sample Weight In (g) | Sample Weight Out (g) | Temp Out (°C.) | Moisture In (%) | Moisture Out (%) | Filling Value In ($cm^3/g$) | Filling Value Out ($cm^3/g$) | FPI (%) | Overall FPI (%) |
|---|---|---|---|---|---|---|---|---|---|---|
| (i) Cigar Filler - Initial Filling Value 5.11 | | | | | | | | | | |
| 10 | 10 | 50 | 29.4 | 36 | 48.1 | 12.9 | 5.70 | 7.21 | 26.49 | 41.10 |
| 5 | 15 | 50 | 29.6 | 38 | 48.1 | 13.5 | 5.70 | 7.27 | 27.54 | 42.27 |
| 5 | 15 | 50 | 30.7 | 38 | 48.1 | 14.6 | 5.70 | 6.53 | 14.56 | 27.79 |
| 10 | 10 | 50 | 30.2 | 41 | 48.1 | 13.6 | 5.70 | 6.58 | 15.44 | 28.77 |
| 20 | 40 | 75 | 28.7 | 56 | 67.0 | 9.0 | 5.70 | 6.36 | 11.58 | 24.46 |
| 15 | 30 | 75 | 30.3 | 46 | 67.0 | 14.7 | 5.70 | 6.70 | 17.54 | 31.12 |
| (ii) Cigarette Cut Lamina - Initial Filling Value 3.92 | | | | | | | | | | |
| 5 | 15 | 3 × 50 | av 33.2 | av 39 | 50.1 | 25.6 | 4.26 | 4.74 | 11.27 | 20.92 |
| 10 | 10 | 50 | 36.4 | 34 | 50.1 | 30.7 | 4.26 | 4.60 | 7.98 | 17.35 |
| 10 | 20 | 3 × 50 | av 30.8 | av 47 | 50.1 | 17.5 | 4.26 | 4.82 | 13.15 | 22.96 |
| 10 | 20 | 100 | 69.6 | 41 | 50.1 | 24.9 | 4.26 | 4.68 | 9.86 | 19.39 |
| 8 | 16 | 2 × 50 | 36.2/ 35.6 | 42/46 | 40.9 | 16.0 | 4.31 | 4.82 | 11.83 | 22.96 |
| 6 | 12 | 100 | 40.2/ 41 | 48/46 | 29.0 | 12.6 | 4.29 | 4.80 | 11.89 | 22.45 |

I claim:

1. A process for treating smoking material comprising the steps of (i) heating smoking material having a moisture content of from 5 to 75% by weight at a temperature of from 70° to 220° C. at about or above atmospheric pressure in the presence of air and (ii) reducing the pressure on the heated smoking material to a level of from 0.1 to 50 kPa at a rate such that the water contained within the smoking material evaporates causing the smoking material to expand, the smoking material being heated during pressure reduction to accelerate water evaporation.

2. Process as claimed in claim 1, wherein the smoking material is heated during step (i) at from 102° to 160° C.

3. Process as claimed in claim 1, wherein the heating of step (i) is carried out with the smoking material subjected to a pressure of from 0.1 to 2 MPa.

4. Process as claimed in claim 1, wherein the smoking material has a moisture content before step (i) of from 20 to 75% by weight.

5. Process as claimed in claim 1, wherein the moisture content of the expanded smoking material is at or below the moisture content of the smoking material before step (i).

6. Process as claimed in claim 1, wherein the moisture content of the expanded smoking material is up to 15% by weight.

7. Process as claimed in claim 1, wherein the smoking material is heated using steam.

8. Process as claimed in claim 1, wherein the smoking material is heated by exposure to radiant heat or microwave radiation.

9. Process as claimed in claim 1, wherein the smoking material is heated during the pressure reduction of step (ii) by exposure to radiant heat.

10. Process as claimed in claim 1, wherein the radiant heat is provided by microwave radiation.

* * * * *